United States Patent [19]

Struck

[11] 3,969,192

[45] July 13, 1976

[54] PROCESS AND APPARATUS FOR QUENCHING HOT COKE

[75] Inventor: Carl-Heinz Struck, Bochum-Dahlhausen, Germany

[73] Assignee: Dr. C. Otto & Comp. G.m.b.H., Bochum, Germany

[22] Filed: Oct. 26, 1973

[21] Appl. No.: 409,812

Related U.S. Application Data

[62] Division of Ser. No. 260,766, June 8, 1972.

[52] U.S. Cl. ..... 202/230; 134/68; 134/131; 134/72; 134/151; 62/380; 209/173

[51] Int. Cl.[2] ..... C10B 39/12

[58] Field of Search ..... 202/227, 229, 230; 201/39; 198/102; 134/67, 68, 130, 131, 72, 133, 134, 151; 62/380; 432/85; 266/6 R; 209/173, 172.5

[56] References Cited

UNITED STATES PATENTS

| | | | |
|---|---|---|---|
| 1,963,861 | 6/1934 | Noll | 209/173 |
| 2,108,649 | 2/1938 | Calderwood | 202/227 |
| 2,110,760 | 3/1938 | Vooys | 209/173 |
| 2,139,047 | 12/1938 | Tromp | 209/173 |
| 2,196,451 | 4/1940 | Holzer | 209/173 |
| 2,764,289 | 9/1956 | Scheid | 209/173 |
| 3,373,086 | 3/1968 | Wilson | 202/230 |

FOREIGN PATENTS OR APPLICATIONS

| | | | |
|---|---|---|---|
| 307,204 | 3/1929 | United Kingdom | 201/39 |

*Primary Examiner*—Norman Yudkoff
*Assistant Examiner*—Hiram H. Bernstein
*Attorney, Agent, or Firm*—Brown, Murray, Flick & Peckham

[57] ABSTRACT

To quench hot coke it is delivered to the surface of water in a tank, where the coke floats. The coke is carried along the surface of the water until it becomes saturated and sinks, whereupon it is removed from the tank. The water adhering to the removed coke is allowed to evaporate.

6 Claims, 3 Drawing Figures

PROCESS AND APPARATUS FOR QUENCHING HOT COKE

This is a division, of application Ser. No. 260,776, filed June 8, 1972.

This invention relates to a process and apparatus for quenching hot coke by immersion in water.

For decades the coke produced in coke ovens has been pushed from the ovens into cars that can be moved along in front of the ovens. The coke on the sloping bottoms of the cars is then quenched by moving the cars under sprinkling apparatus located under an exhaust vent for the quench vapors. These vapors are formed in large quantities and appear as an ascending white cloud that characterizes a coke oven battery or a large gas plant. The formation of quench vapors is due to the fact that parts of the quenching water are heated to above 100°C by the hot coke. With the customary sprinkling of the coke, that applies for a considerable part of the quench water. The quench vapors contain large quantities of dust and other impurities and create a pollution problem that is highly objectionable, especially in residential areas. The coke is not deposited uniformly in a quench car, and the quantity of water with which the individual parts of the coke load are sprinkled is not uniform. Moreover, the amount of water absorbed by the coke depends upon the size of the individual coke pieces and is variable.

It also is known that coke can be quenched, at least partially, by dipping it in water. With Brouwer troughs and the many developments of them, the coke is introduced into a trough filled with water and is advanced along it by scrapers or a belt, for example, provided with orifices. Then the coke is discharged from the trough. Usually, while the coke is in the trough it also is sprinkled with water. On the other hand, in the known pure immersion process, the coke is charged into a vat of perforated iron sheeting and then the vat is immersed in a vessel containing water. After the coke has been quenched in this manner the vat with its load is removed from the vessel and the coke is emptied onto a coke ramp, to which the vat has been moved. With such a process quench fumes are produced that are objectionable and cause damage. Furthermore, this process is not suitable for use with large ovens.

It is an object of this invention to quench all parts of burning coke and thereby to arrive at only a moderate water content in the cooled coke. It also is an object of the invention to avoid the fumes that escape from the standard quench towers and cause damage. A further object is to classify the coke as to size as it is being quenched.

This invention, in which hot coke is immersed in water, is based on the finding that hot pieces of coke, if they are dumped into water, float at first and then sink as they become saturated with water. The larger the pieces and the less the porosity of the coke, the longer it takes for the coke to sink. Tests have shown that with a standard Ruhr coke the time between immersion of the coke in water and the sinking of the coke pieces that were 40 mm in size was approximately 10 to 15 seconds. With coke pieces of an 80 mm size the time was approximately 24 to 40 seconds.

In accordance with this invention the quenching of the hot coke takes place in such a way that the coke is delivered to the surface of water in a tank and is moved along the tank as it floats in the water until the coke pieces become heavy enough, due to saturation with water, to sink. They are then immediately removed from the tank and placed on a belt conveyor or an open ramp where evaporation of the adherent water takes place. If necessary, evaporation can be speeded by introducing heat. With this process, all coke pieces absorb the same quantity of water in relation to their weight, so the coke is quenched uniformly. The excess adhering water evaporates relatively rapidly.

The preferred embodiment of the invention is illustrated in the accompanying drawings, in which FIG. 1 is a plan view;

Figure 1:
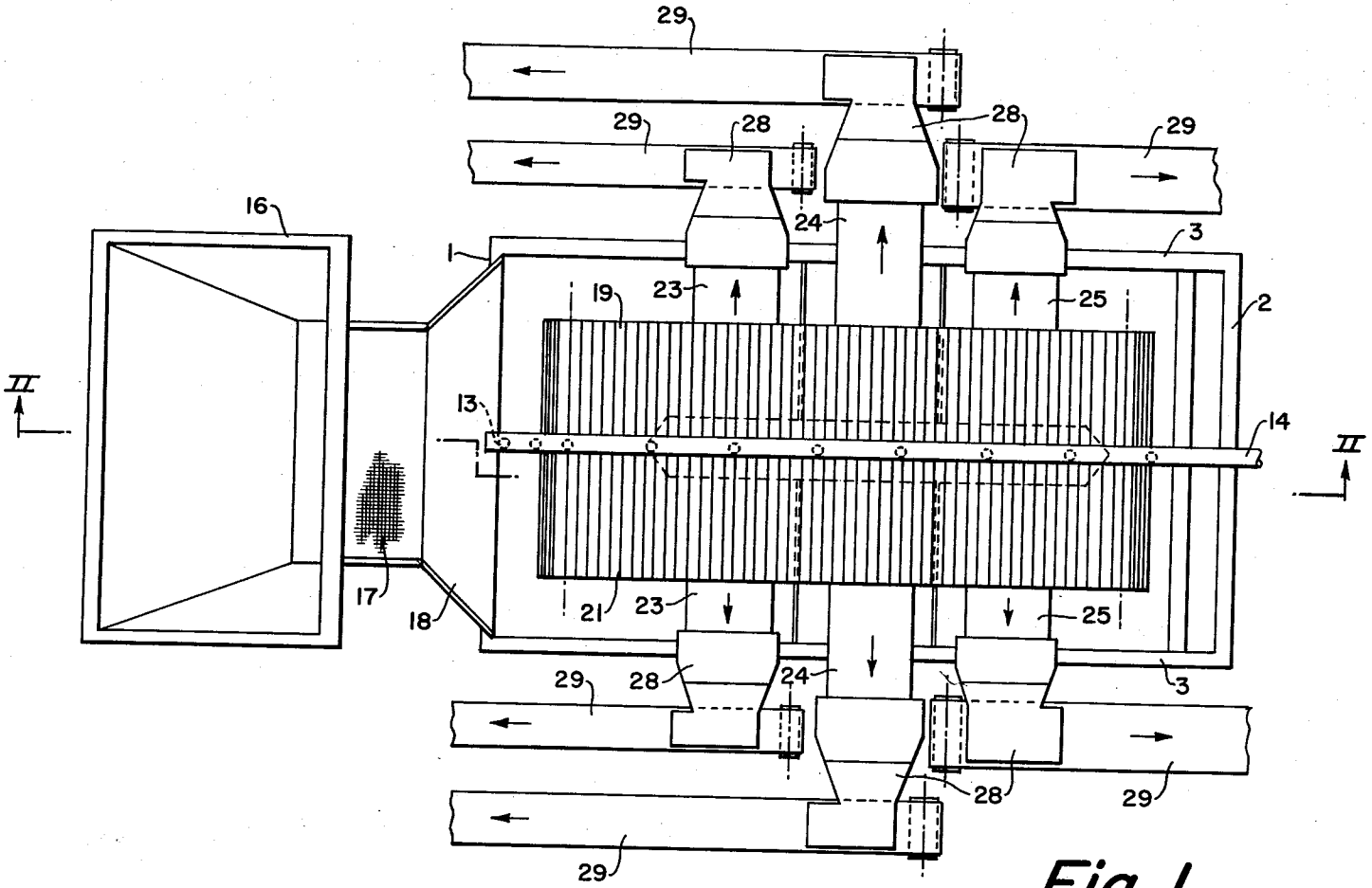
Figure 2:
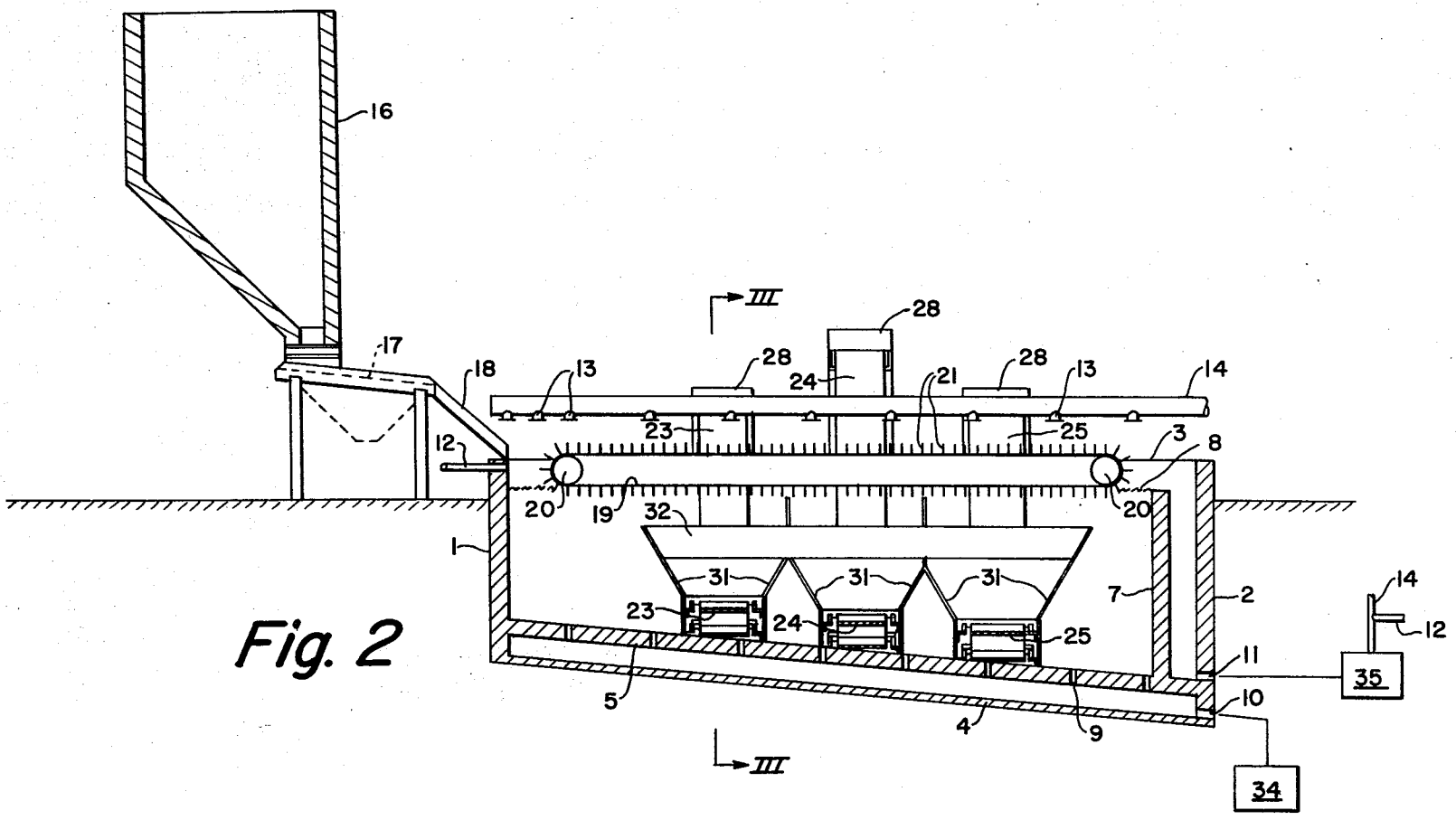
FIG. 2 is a longitudinal section taken on the line II—II of FIG. 1.

Referring to FIGS. 1 and 2 of the drawings, a rectangular water tank has front and rear end walls 1 and 2 connected by side walls 3 and a bottom wall 4 sloping from the front wall to the back wall. There also is a sloping floor 5 in the tank a short distance above the tank bottom. Extending upwardly from this floor near the rear end wall of the tank is a partition 7 that extends entirely across the tank but does not extend upwardly as high as the tank end walls. The tank is filled with water to the level of the top of the partition. The water level is indicated by the line 8. Additional water has to be supplied to the tank continuously because some of the water escapes through openings 9 in the tank floor and out of the tank through an outlet 10 in the rear end wall between the floor and the bottom of the tank. Also, enough water is supplied to the tank for it to flow over the partition and down between it and the rear end wall, which has an outlet 11 for escape of the water. Part of the make-up water is delivered to the tank by a pipe 12 extending through an opening in the top of the front wall 1. Water can also be supplied through the side walls. The rest of the water comes from spray nozzles 13 in a pipe 14 above the tank and that extends lengthwise of the tank.

Near the front end of the tank but at a higher level there is a hopper 16 for receiving hot coke dumped into it from cars that run along the front of a coke oven battery where they are loaded with hot coke in the usual way. The hopper delivers the coke to an inclined vibrating screen 17 that shakes out the fines, such as particles below approximately 10 mm. These can be cooled in a separate suitable operation. The coke leaving the lower end of the screen slides down a chute 18 into the water, where it floats. The coke enters the water along a broad front. The spray nozzles 13 above the tank are concentrated above the area immediately adjacent the front wall of the tank. The water entering the tank flows toward its rear end and carries the floating coke along with it. In addition, the coke is advanced through the water by means of an endless belt 19 extending around rollers 20 suitably journalled in the upper part of the tank. One of the rollers is driven continuously in a direction to cause the lower length of the belt to move from the front end towards the rear end of the tank. The belt is provided with transverse strips 21 that dip into the water and push the floating coke along. They also hold the coke down in the water so that the coke pieces will be saturated sooner.

Figure 3:
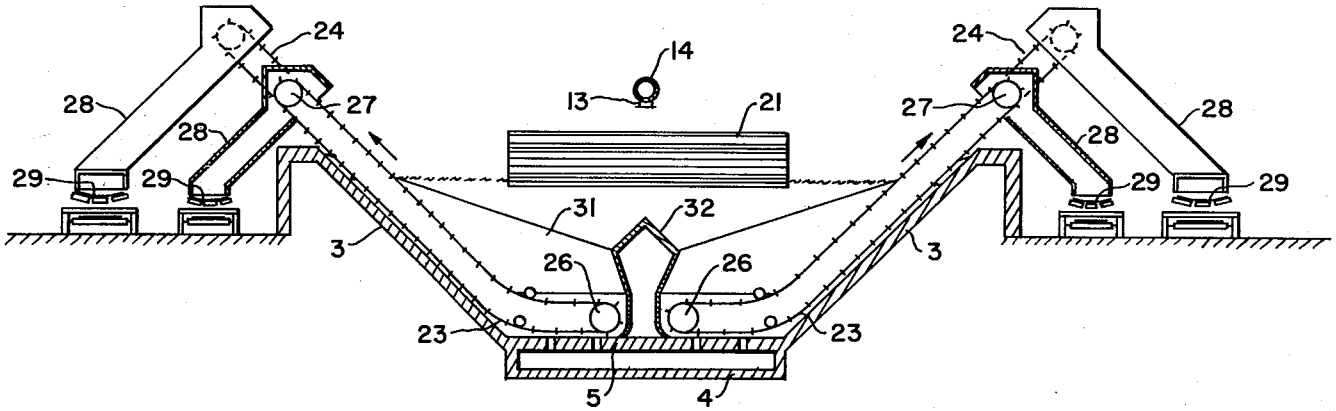
FIG. 3 is a cross section taken on the line III—III of FIG. 2.

As the coke moves through the water it becomes saturated and therefore heavy enough to sink. The sinking coke settles onto endless conveyors 23, 24 and 25 that carry it out of the tank over the tank side walls. Preferably, there are three pairs of transverse conveyors, each pair carrying the coke out of both sides of the tank. As shown in FIG. 3, each conveyor belt extends around a roller 26 at the bottom of the tank near its longitudinal center line. From there the belt extends up the adjacent inclined side of the tank to a driven roller 27 at the upper end of a chute 28, down through which the coke slides onto an endless horizontal belt conveyor 29 that carries the coke away from the tank. Three pairs of conveyors are used because the smaller pieces become saturated and sink first, while it takes the larger pieces longer to sink. Therefore, the first conveyors 23 receive the smaller pieces of coke, the middle conveyors 24 catch the medium size pieces, and the large pieces sink onto the remaining conveyors 25. The coke leaving the tank by means of the three pairs of conveyors therefore is classified into three different sizes. Inside the tank upwardly diverging side plates 31 guide the sinking coke onto the different conveyors. Also, there is a central deflecting plate 32 extending lengthwise of the tank to aid in guiding the sinking coke to the underlying conveyors.

Fine particles of coke that sink almost immediately are carried down through the perforated floor 5 of the tank by the water flowing through the openings 9 in the floor and are washed out through the lower outlet 10 to a settling tank 34. The water overflowing the partition in the tank and leaving through outlet 11 is conducted to cooling apparatus 35 and then returned to the inlet pipe 12 and the spray pipe 14.

With this apparatus the formation of quench fumes can be practically eliminated due to the fact that the quantity of water that comes in contact with the coke is so great that the water is not heated to 100°C. This is achieved, for example, by making the tank large enough and providing a sufficiently large relative velocity between the coke pieces being quenched and the water flowing near the surface of the tank. Means may be provided, if desired, for adjusting the overflow over partition 7.

Instead of the belt conveyors outside of the tank, ramps can be provided near the tank for receiving coke from chutes 28.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A coke quenching apparatus comprising a substantially rectangular water tank adapted to be filled with water to a predetermined level for the quenching of pieces of hot coke, hopper means receiving hot coke for quenching in said tank, means for separating fines from those pieces of hot coke which are to be quenched by the water in said tank, means for delivering the hot pieces of coke from said hopper means into the water contained by said tank at a location which is adjacent one side wall of the tank, spray nozzles above the tank for spraying water on the hot coke as it enters the tank, means for supplying the main quantity of water at said one side wall of the tank, conveyor means above the water in the tank for moving pieces of coke floating in the water from a location which is adjacent said one side wall toward the opposite side wall of the tank, said conveyor means being constructed to advance the pieces of coke in the tank only while floating in the water until each piece of coke becomes saturated due to absorption of a quantity of water in relation to the weight of the pieces of coke, and an endless conveyor belt means in the tank for receiving the pieces of coke which become saturated and sink onto it, said endless conveyor belt means being arranged to carry the pieces of coke which sink onto it in a direction transversely of the direction of movement of said conveyor means to discharge the saturated pieces of coke from said tank.

2. An apparatus according to claim 1 wherein said endless conveyor belt means includes a plurality of endless conveyor belts arranged at spaced-apart locations between said one side wall and said opposite side wall of the tank, said apparatus further comprising guide plates for guiding the sinking pieces of coke onto one of the endless conveyor belts in the tank.

3. Apparatus according to claim 2 wherein said plurality of endless conveyor belts includes conveyor belts extending from opposite sides of said tank.

4. Apparatus according to claim 1, including means for circulating water through the tank.

5. Apparatus according to claim 4, including means for cooling water discharged from the tank and returning it to the tank.

6. Apparatus according to claim 1, including a raised floor in the tank spaced from its bottom wall and provided with openings therethrough for escape of water and coke breeze.

* * * * *

UNITED STATES PATENT OFFICE

CERTIFICATE OF CORRECTION

Patent No. 3,969,192 Dated July 13, 1976

Inventor(s) Carl-Heinz Struck

It is certified that error appears in the above-identified patent and that said Letters Patent are hereby corrected as shown below:

Front Page - insert

Foreign Application Priority Data

July 22, 1971 - Germany . . . . . P 21 36 623.4

Signed and Sealed this

Second Day of November 1976

[SEAL]

*Attest:*

RUTH C. MASON
*Attesting Officer*

C. MARSHALL DANN
*Commissioner of Patents and Trademarks*